US005799560A

United States Patent [19]

Meng

[11] Patent Number: 5,799,560

[45] Date of Patent: Sep. 1, 1998

[54] CHECK VALVE FOR CONTROLLING THE EXTRACTING MOVEMENT OF A PNEUMATIC THREADED FASTENER-SETTING TOOL

[76] Inventor: Tien-Ju Meng, Suite 2, 7F, No. 95-8 Chang Ping Road, Sec. 1, Taichung, Taiwan

[21] Appl. No.: 654,154

[22] Filed: May 28, 1996

[51] Int. Cl.[6] ..... F15B 13/042

[52] U.S. Cl. ..... 91/404

[58] Field of Search ..... 91/404

[56] References Cited

U.S. PATENT DOCUMENTS 2,587,182 2/1952 Livers ..... 91/404

3,667,647 6/1972 Patrick ..... 91/404

3,967,539 7/1976 Williamson ..... 91/404

*Primary Examiner*—Sheldon Richter

[57] ABSTRACT

A check valve for controlling a pneumatic threaded fastener-setting tool comprises a hollow cylinder housing connected between the tool and a pneumatic source for transmitting the air pressure therethrough, a retaining ring, a stopper member, a guider member, a slide and the springs sequentially disposed inside the housing. An actuator rod inserted into the tool pushes the slide moving inward for permitting the stopper member to close an air duct in order to interrupt the air fluid from going through thus to stop a shank of the tool from further extracting movement.

1 Claim, 2 Drawing Sheets

CHECK VALVE FOR CONTROLLING THE EXTRACTING MOVEMENT OF A PNEUMATIC THREADED FASTENER-SETTING TOOL

BACKGROUND OF THE INVENTION

The present invention relates to the pneumatic tools, and more particularly to an check valve for controlling the extracting movement of a pneumatic threaded fastener-setting tool which valve has a structure specified to connect with the above mentioned tool and a pneumatic source therebetween so as to control the driving shank of the tool from excessive retracting movement.

Normally, female screw threads of a movable machine will be worn off because of long application and vibrations. Thus, the male screw thread fastened therein becomes loose. This not only mars the original function of a machine but also effects greatly the industrial safety. To solve such problem, people adapt an economic measurement by widening the original female screw thread and scoring new female thread and then embedding a bushing means therein in order to fixedly fasten the male screw thread again. Since that the bushing means has an external thread coped with the newly scored female thread and an internal thread coped with the original male thread, this re-fastening will be more reliable.

Currently, a pneumatic threaded fastener-setting tool is employed to finish this job. The tool of a conventional type has a shank rotatably and slidingly secured to the forward end thereof. The shank has a threaded tip which assumes the responsibility of embedding the bushing means. The shank is driven forward in clockwise rotation and backward in reverse rotation by a cylinder and a driving clutch inside the tool and alternately operated by pneumatic force. When embeds the bushing means, the shank is driven forward and extracted when the bushing means is embedded. The problem occurs when the shank is driven backward that there has no any device therein to stop the excessive extracting movement or to limit it's extracted position, so that the shank moves unlimitedly until it strikes against the bottom of the cylinder inside the tool and that the repeated strokes of the shank against the bottom of the cylinder make the tool damageable. Thus a check valve for controlling the unlimited extracting movement of the shank is of the great urgency at present.

SUMMARY OF THE PRESENT INVENTION

The main object of the present invention is to provide a check valve which is specifically designed to cope with a pneumatic threaded fastener-setting tool and interrupts the pneumatic fluid to control the shank of the tool from excessive extracting movement.

Another object of the present invention is to provide a check valve to prevent the tool from damageable operation in order to lasting the longevity of the tool.

To fulfill the aforementioned objects, the present invention of a check valve comprises generally a hollow cylinder housing coupled with a threaded fastener-setting tool and connected with a pneumatic source respectively so as to facilitate the transmission of the air pressure to the tool. The housing comprises a plurality of air ducts and the operation compronents therein, among which a stopper member is adapted and an actuator rod will be pushed to move to actuate a slide which is in turn to move to facilitate the stopper member closing a passage way for interrupting the air pressure from flowing into the tool. So that the extracting movement of the shank will be immediately stopped and the stroke of the shank against the bottom of the cylinder is avoidable.

The present invention will become fully understood by reference to the following detailed description thereof when read is conjunction with the attached drawings.

DETAILED DESCRIPTION OF THE PREFERRED EMBODIMENT

Figure 1:
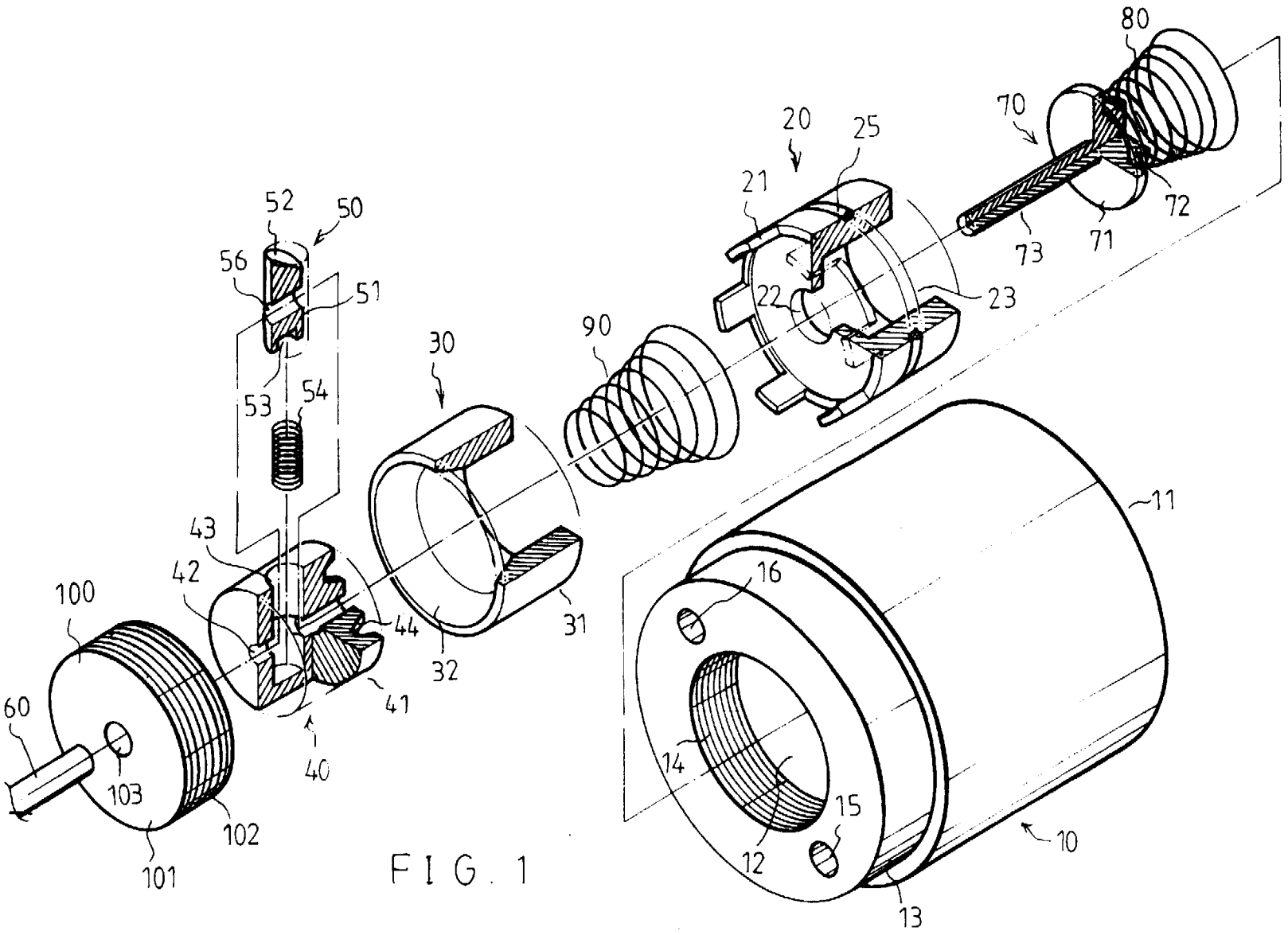
FIG. 1 is an exploded perspective view to show a preferred embodiment of the present invention.
Figure 2:
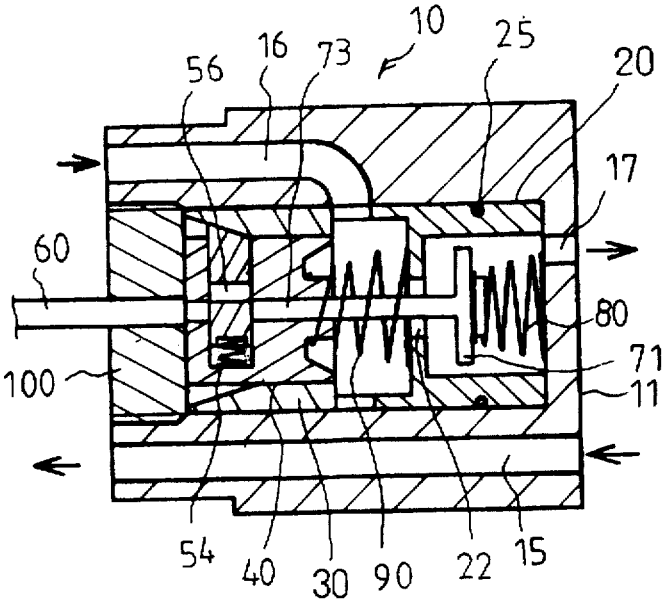
FIG. 2 is a sectional view to show an assembled check valve of the present invention.

With reference to the FIGS. 1 and 2 of the drawings, the check valve of the present invention comprises a hollow cylinder housing 10, an annular retaining ring 20, a guider member 30, a slide 40, a detent means 50, an actuator rod 60, a stopper member 70, a first spring 80, a second spring 90 and a cover 100.

The hollow cylinder housing 10 has a bottom 11, an opening 12, a neck 13 abutting the opening 12 having thread 14 on the inner periphery thereof, the neck 13 which is formed to facilitate the housing coupling with a pneumatic threaded fastener-setting tool of conventional type (not shown), a first air duct 15 extended from the rim of the neck 13 and through the wall of the housing for transmitting the air pressure from a pneumatic source to the tool, a second air duct 16 through the wall started at the opposing rim of the neck 13 and ended at a medial portion of the inner wall and a third air duct 17 in the bottom 11 for passing the return air pressure from the tool.

The annular retaining ring 20 which is fixedly disposed into the housing 10 and abutting the inner surface of the bottom 11 thereof has a central bore 22 on a closed end which defines a cylindrical chamber 23 with the bottom of the housing therebetween, a plurality of extensions 21 circumferentially projected spaced apart from the closed end and an annular groove 25 on the outer wall thereof for fixing a sealing ring therein so that the air pressure will not leak from between the outer wall of the retaining ring 20 and the inner wall of the housing 10.

The guider member 30 which disposes inside the housing 10 at a medial portion thereof, has a generally annular body 31 having one end stopped against the extensions 21 of the retaining ring 20 and the other end a tapered guide 32 having camming surface formed on the inner periphery thereof.

The slide 40 which is partially disposed inside the guider member 30, has a cylinder body 41, a central bore 42 through the body 41 and along the axis thereof, a radial recess 43 extended from an outer periphery across the central bore 42 and ended at an opposite periphery therein for slidingly disposing the detent means 50 therein and an annular groove 44 in the inward end for biasing the second spring 90 therein. The detent means 50 has a cylinder body 51 sizably equal to the recess 43, a vedge surface 52 at upper end which is made in registry with the camming surface of the tapered guide 32 of the guider member 30, a circular recess 53 at the lower end for biasing a third spring 54 therein and a transverse aperture 56 through the medial portion of the body 51. The aperture 56 aligns with the central bore 42 of the slide 40 but they are normally bias each other because of the resilient force of the spring 54.

The cover 100 which has circular body 101, a threaded outer periphery 102 made in registry with the thread on the inner periphery 14 of the opening 12 so that the cover 100 is fastened into the opening 12, and a central bore 103 through the axis of the body 101 for permitting the actuator rod 60 sliding through thereabout.

The stopper member 70 disposed in the chamber 23 has a neck 72 thereof projected from the inward side for biasing the first spring 80 and a stem 73 in predetermined length centrally projected from the other side thereof. The stem 73 inserts sequentially through the central bore 22 of the retaining ring 20, the second spring 90, the guider member 30 and the central bore 42 of the slide 40 and then stops against an outer periphery of the detent means 50 (as shown in FIG. 2).

When assembled, the neck 13 of the housing 10 axially inserts into the rear end of a pneumatic threaded fastener-setting tool as the first and second air ducts 15 and 16 align with their corresponding air ducts inside the tool and the other end of the housing 10 connects to a pneumatic source. The actuator rod 60 has at one end inserting into the tool in a predetermined length and the other end inserting through the cover 100 and then stopping against the forward end of the slide 40.

Figure 3:
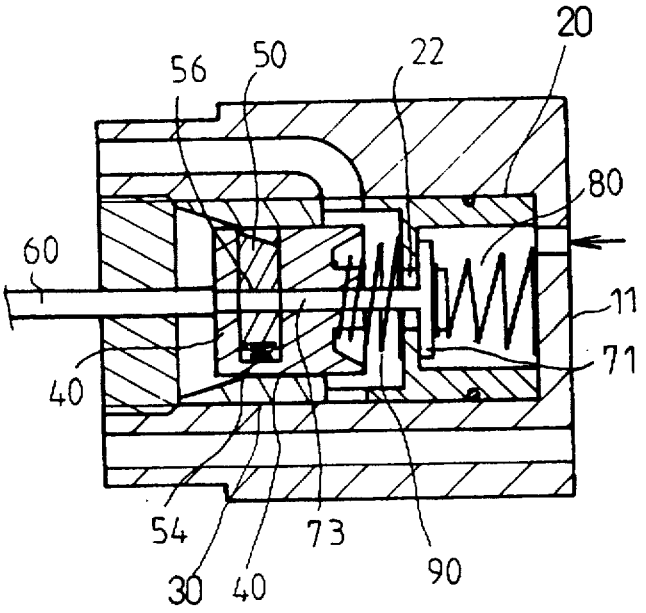
FIG. 3 is a sectional view to show a passage way for the air pressure which has been closed by a stopper member according to the present invention.

Referring to FIGS. 2 and 3, the air pressure comes through the first air duct 15 and enters into the tool (not shown) in order to actuate a cylinder which under control of a clutch device, to drive a shank of the tool moving forward in clockwise rotation, or backward in reverse rotation. The air pressure normally returns through the second air duct 16, the central bore 22 and the third air duct 17 (as shown in FIG. 2). After a workpiece is set, the air pressure will alternately come from the third air duct 17 through the central bore 22 and the second air duct 16 entering into the tool to actuate the cylinder for driving the shank to move backward in reverse rotation. When the shank extracts to a limited position, it will touch to push the actuator rod 60 moving backward, so that the slide 40 is pushed by the other end of the actuator rod 60 moving towards the guider member 30. Meanwhile, the vedge surface 52 on the upper end of the detent means 50 which is substantially engages with the camming surface of the tapered guide 32, is now moved downward within the radial recess 43 until that the transverse aperture 56 aligns with stem 73 and permits the stem 73 inserting therethrough. As a result that the circular body 71 of the stopper member 70 now is closed the central bore 22 by the air pressure and the resilient force of the first spring 80 (as shown in FIG. 3). Consequentially, the air fluid is interrupted and the extracting movement of the shank inside the tool is immediately eased. Since the stricking of the shank against the bottom of the cylinder is prevented, the tool will be durable. When the air pressure comes from the first air duct 15 again, the return air pressure through the second air duct 16 will force the circular body 71 of the stopper to retreat to a normal position and the second spring 90 urges the the slide 40 sliding out of the guider member 30 so as to permit the free end of the stem 73 disengaged with the transverse aperture 43 and the detent means urged by the spring 54 moving upward to a normal position (as shown in FIG. 2).

Note that the specification relating to the above embodiment should be construed as to exemplary rather than as limitative of the present invention, with many variations and modifications being readily attainable by a person of everage skill in the art without departing from the spirit or scope thereof as defined by the appended claims and their legal equivalents.

I claim:

1. A check valve for controlling a pneumatic threaded fastener-setting tool comprising:

a hollow cylinder housing for engaging with said tool and a pneumatic source respectively, said housing having a bottom at one end, an opening at the other end, a neck abutting said opening including thread on inner periphery, a first air duct extended from a rim of said neck through a peripheral wall and ended at an outer surface of said bottom, a second air duct extended from an opposite rim of said neck through an opposite peripheral wall and ended at a medial portion of an inner wall thereof, and a third air duct formed through said bottom thereof;

an annular retaining ring fixedly disposed into said housing abutting said bottom thereof, said retaining ring having a closed end so as to define a cylindrical chamber with said bottom therebetween, a central bore on said closed end, a plurality of extensions projected spaced apart from a circumference of said closed end and an annular groove formed around an outer periphery thereof for securing a sealing ring therein;

a guider member disposed inside said housing and stopped at one end against said extensions, said guider member having a generally annular body and a tapered guide of camming surface formed on an inner periphery at the other end thereof;

a slide disposed into said guider member from said tapered guide thereof, said slide having a cylinder body, a central bore through said body and along the axis thereof, a radial recess extended from an outer periphery across said central bore and ended at an opposite periphery therein and an annular groove formed in an inward end thereof for biasing a spring means therein;

a detent means slidingly disposed into said radial recess of said slide, said detent means having a cylinder body sizably equal to said radial recess, a vedge surface at an upper end for engaging with said camming surface of said tapered guide, a circular recess at a lower end for biasing a spring means therein and a transverse aperture through a medial portion of said body which aligns with said central bore of said slide and normally biases each other by said third spring;

a circular cover fastened into said opening of said housing,said cover having thread on outer periphery made in registry with the thread on the inner periphery of said neck and a central bore through the axis thereof for sliding an actuator rod therethrough, said actuactor rod having a first end inserted into said threaded fastener-setting tool in a predetermined length thereof and a second end stopped against a forward end of said slide;

a stopper member disposed inside said chamber between said retaining ring and the bottom of said housing, said stopper having a circular body, a neck centrally projected from a side thereof for biasing a first spring means thereon and a stem means in predetermined length centrally projected from a second side thereof, said stem mean having a free end inserted sequentially through the central bore of said retaining ring, said second spring means, said guider member and the central bore of said slide, and then stopping against an outer periphery of said detent means;

whereby said actuator rod moves to push said slide moving inward toward said guider member and said detent means moving downward by the camming surface of said tapered guide so as to permit the free end of said stem means engaged into the transverse aperture of said detent means for facilitating the circular body of said stopper member closing the central bore of said retaining ring in order to interrupt the air fluid from going through for stopping a shank of said tool from further extracting movement.

* * * * *